US010184430B2

(12) United States Patent
Watanabe et al.

(10) Patent No.: US 10,184,430 B2
(45) Date of Patent: Jan. 22, 2019

(54) DIAGNOSTIC DEVICE FOR EVAPORATED FUEL PROCESSING DEVICE

(71) Applicant: Nissan Motor Co., Ltd., Yokohama-shi, Kanagawa (JP)

(72) Inventors: Kazuhisa Watanabe, Kanagawa (JP); Kazuki Toyoda, Kanagawa (JP); Hitoshi Oohashi, Kanagawa (JP); Toshiaki Inoue, Kanagawa (JP)

(73) Assignee: Nissan Motor Co., Ltd., Yokohama-shi, Kanagawa (JP)

( * ) Notice: Subject to any disclaimer, the term of this patent is extended or adjusted under 35 U.S.C. 154(b) by 0 days.

(21) Appl. No.: 15/739,020

(22) PCT Filed: Jun. 23, 2015

(86) PCT No.: PCT/JP2015/067948
§ 371 (c)(1),
(2) Date: Dec. 21, 2017

(87) PCT Pub. No.: WO2016/207964
PCT Pub. Date: Dec. 29, 2016

(65) Prior Publication Data

US 2018/0171938 A1 Jun. 21, 2018

(51) Int. Cl.
*F02M 25/08* (2006.01)
*F02D 41/00* (2006.01)
*F02D 41/22* (2006.01)

(52) U.S. Cl.
CPC ..... *F02M 25/0818* (2013.01); *F02D 41/0037* (2013.01); *F02M 25/089* (2013.01);
(Continued)

(58) Field of Classification Search
CPC ..... F02M 25/0818; F02M 25/089; F02D 41/0037; F02D 2041/224
See application file for complete search history.

(56) References Cited

U.S. PATENT DOCUMENTS 5,295,472 A * 3/1994 Otsuka ..... F02M 25/0809 123/198 D
5,803,055 A 9/1998 Goto et al.
(Continued)

FOREIGN PATENT DOCUMENTS

JP H08232778 A 9/1996
JP H10104114 A 4/1998
(Continued)

*Primary Examiner* — Jacob Amick
*Assistant Examiner* — Charles Brauch
(74) *Attorney, Agent, or Firm* — Young Basile Hanlon & MacFarlane, P.C.

(57) ABSTRACT

A diagnosis device for an evaporated fuel processing device includes: a pump arranged to pressurize or depressurize a system including the fuel tank and the canister; at least one pressure sensor arranged to sense a pressure within the system; and a fuel temperature sensor arranged to sense a temperature of a fuel within the fuel tank, the diagnosis device being configured to select a first leakage diagnosis using a positive pressure or a negative pressure existing within the fuel tank, or a second leakage diagnosis using a forcible pressurization or a forcible depressurization by the pump, based on a temperature difference between a fuel temperature at a start of driving, and a fuel temperature after an end of the driving, with respect to a request of a leakage diagnosis.

5 Claims, 5 Drawing Sheets

(52) U.S. Cl.
CPC ... *F02M 25/0836* (2013.01); *F02D 2041/224* (2013.01); *F02D 2041/225* (2013.01); *F02D 2200/0414* (2013.01); *F02D 2200/0602* (2013.01); *F02D 2200/0606* (2013.01); *F02M 2025/0845* (2013.01)

(56) References Cited

U.S. PATENT DOCUMENTS

| | | | |
|---|---|---|---|
| 2007/0068227 | A1 | 3/2007 | Tsuyuki et al. |
| 2012/0186333 | A1 | 7/2012 | Nishimura et al. |
| 2014/0224212 | A1 | 8/2014 | Tamura et al. |
| 2015/0013437 | A1 | 1/2015 | Takakura |
| 2015/0096355 | A1 | 4/2015 | Makino et al. |

FOREIGN PATENT DOCUMENTS

| | | | | |
|---|---|---|---|---|
| JP | 2007092589 | A | | 4/2007 |
| JP | 2007177653 | A | * | 7/2007 |
| JP | 2007177653 | A | * | 7/2007 |
| JP | 4107053 | B2 | | 6/2008 |
| JP | 4715426 | B2 | | 7/2011 |
| JP | 2012149592 | A | | 8/2012 |
| JP | 2013185528 | A | | 9/2013 |
| WO | 2013133235 | A1 | | 9/2013 |
| WO | 2014061135 | A1 | | 4/2014 |

* cited by examiner

DIAGNOSTIC DEVICE FOR EVAPORATED FUEL PROCESSING DEVICE

TECHNICAL FIELD

This invention relates to an evaporated fuel processing device arranged to process an evaporated fuel generated within a fuel tank at refueling by using a canister, specifically to a diagnosis device arranged to diagnose whether or not there is the leakage.

BACKGROUND

Conventionally, an evaporated fuel processing device is widely used. This evaporated fuel processing device is arranged to temporarily adsorb an evaporated fuel generated in a fuel tank of a vehicle to a canister using adsorption material (adsorbent) such as activated carbon, then to purge combustion components from the canister by introduction of flesh air during driving of the internal combustion engine, and to introduce it into an intake system of the internal combustion engine.

Japanese Patent No. 4107053 discloses an evaporated fuel processing device which includes a blocking valve provided in a passage between a fuel tank and a canister, and which is basically arranged to adsorb an evaporated fuel from the fuel tank in the canister only at a refueling. That is, a fuel tank is maintained in a sealed state by the blocking valve during a stop of the vehicle, except for the refueling. This is a system arranged to surely prevent outflow of the evaporated fuel to the outside.

The evaporated fuel processing device of the patent document 1 includes a diagnosis device arranged to diagnose whether or not there is a leakage of each portion. The diagnosis device of Japanese Patent No. 4107053 includes a negative pressure pump connected to a drain port side of the canister. The inside of the system including the fuel tank and the canister is depressurized by this negative pressure pump at an appropriate timing during the stop of the vehicle. The existence of the leakage is judged based on the pressure variation of the inside of the system at that time.

However, in this leakage diagnosis using the pump, the energy consumption according to the actuation of the pump is generated at each diagnosis.

On the other hand, Japanese Patent No. 4715426 proposes a leakage diagnosis performed by using a pressure variation within a tank by a difference between an outside air temperature and a fuel temperature after a stop of an engine, without using a pump.

However, a fuel tank of a sealed type which is used in an evaporated fuel processing device including a blocking valve generally has a large thickness and a rigid configuration. Accordingly, a variation of a fuel temperature by the outside air temperature is difficult to be obtained.

SUMMARY

A diagnosis device for an evaporated fuel processing device arranged to adsorb an evaporated fuel generated in a fuel tank at a refueling by a canister, and to process by introducing the evaporated fuel to an intake system of an internal combustion engine during a driving of the internal combustion engine, the diagnosis device comprises:

a pump arranged to pressurize or depressurize a system including the fuel tank and the canister;

at least one pressure sensor arranged to sense a pressure within the system; and a fuel temperature sensor arranged to sense a temperature of a fuel within the fuel tank;

the diagnosis device being configured to select a first leakage diagnosis using a positive pressure or a negative pressure existing within the fuel tank, or a second leakage diagnosis using a forcible pressurization or a forcible depressurization by the pump, based on a temperature difference between a fuel temperature at a start of driving, and a fuel temperature after an end of the driving, with respect to a request of a leakage diagnosis.

In a case where there is a temperature difference between a fuel temperature after the start of the driving and a fuel temperature after the driving to some extent, it is conceivable that the inside of the fuel tank is the positive pressure or the negative pressure. Accordingly, the leakage diagnosis is performed without actuating the pump. For example, in a state where the system is sealed, it is sensed whether or not there is the leakage by monitoring the pressure variation within the system.

In a case where the temperature difference is insufficient, the pump is actuated to bring the inside of the system to the positive pressure or the negative pressure. Then, the leakage diagnosis is performed. For example, the system is sealed in the positive pressure state or the negative pressure state. Then, the pressure variation within the system is monitored. With this, the existence of the leakage is sensed.

In this way, in the present invention, when the pressure variation naturally generated during the driving can be used, the leakage diagnosis is performed without depending on the pump. Accordingly, it is possible to decrease the actuation frequency of the pump, and thereby to suppress the energy consumption.

DETAILED DESCRIPTION OF THE EMBODIMENTS

Figure 1:
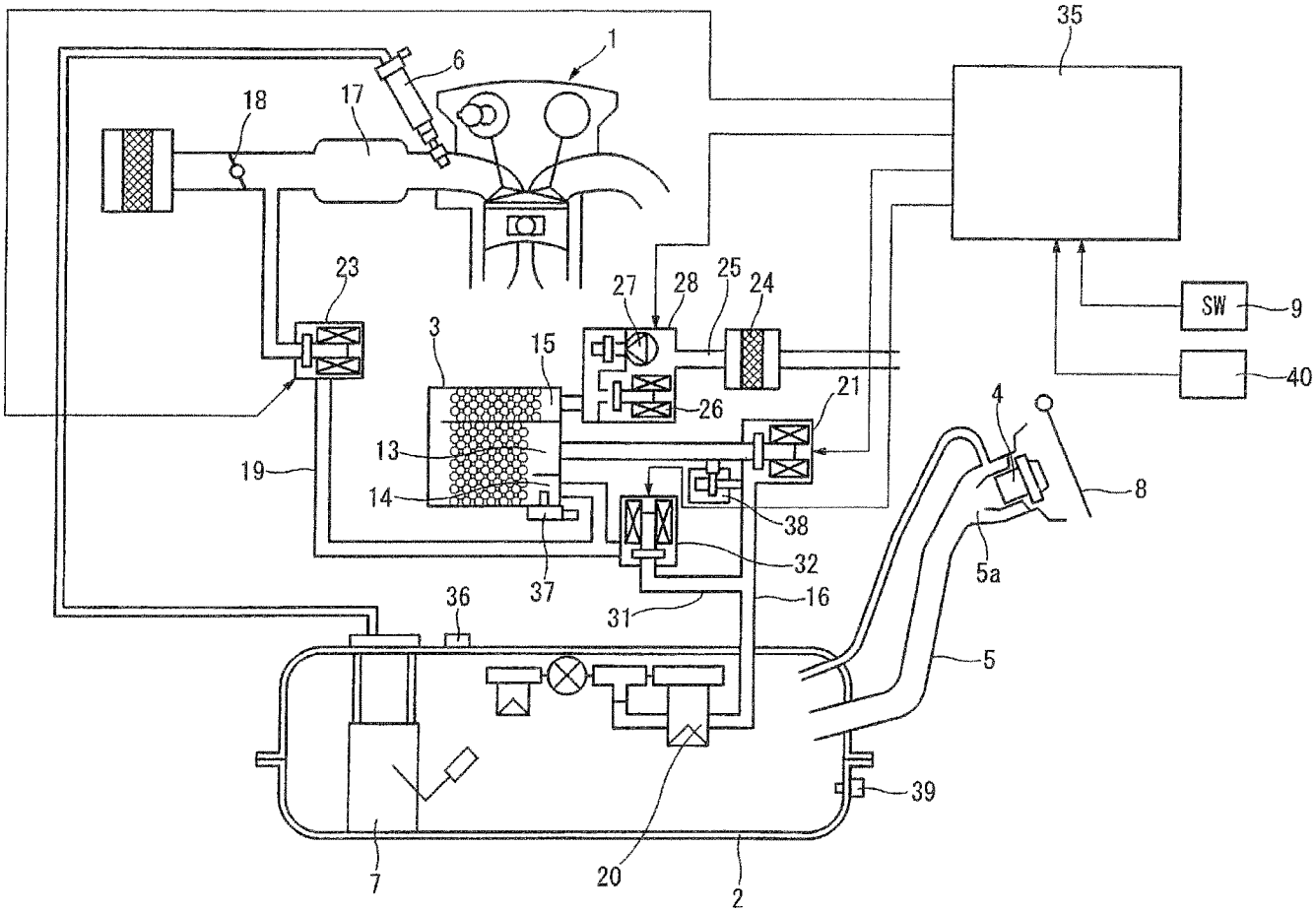
FIG. 1 is a configuration explanation view showing one embodiment of an evaporated fuel processing device according to the present invention.

FIG. 1 is a configuration explanation view showing one embodiment of an evaporated fuel processing (treating) device according to the present invention. An internal combustion engine 1 is mounted to a vehicle not shown. A (hermetically) sealed type fuel tank 2 is provided to the vehicle. Moreover, an evaporated fuel processing device using a canister 3 is provided for processing an evaporated fuel generated in the fuel tank 2 at the refueling. The fuel tank 2 includes a refueling pipe portion 5 including a refueling opening (oil filler port) 5*a* having a tip end to which a filler cap 4 is detachably mounted. A fuel pump unit 7 is received within the fuel tank 2. The fuel pump unit 7 is arranged to supply the fuel to a fuel injection device 6 of the internal combustion engine 1. The refueling opening 5*a* is covered with a fuel lid 8 arranged to be electrically locked for restricting an opening of the filler cap 4 in a state where a pressure within the fuel tank 2 is high. This fuel lid 8 is arranged to release the lock based on a signal of a lid open switch 9 provided to a driver seat and so on, in a state where the pressure within the fuel tank 2 is lowered. Besides, the filler cap 4 itself may be locked in place of the lock of the fuel lid 8.

The canister 3 includes a fluid passage which has a U-turn shape, and which is formed by a case made from a synthetic resin. Adsorption material (adsorbent) such as activated carbon is received (filled) within the canister 3. A charge port 13 and a purge port 14 are provided at one end portion of the flow passage having the U-turn shape in the flow direction. The charge port 13 is an inflow portion of the evaporated fuel. The purge port 14 is an outflow portion of the purge gas including combustion (combustible) components. A drain port 15 is provided at the other end portion of the flow passage in the flow direction. The drain port 15 is arranged to take outside air at the purge.

The charge port 13 is connected through an evaporated fuel passage 16 to an upper space of the fuel tank 2. Besides, a tip end portion of this evaporate fuel passage 16 on the fuel tank 2's side is connected to the upper space of the fuel tank 2 through an FLV valve 20 arranged to prevent the liquid fuel from overflowing into the evaporated fuel passage 16 when the fuel liquid level is high. A blocking valve (closing valve) 21 is provided in the middle of the evaporated fuel passage 16. The blocking valve 21 is arranged to open and close the evaporated fuel passage 16. Generally, this blocking valve 21 is arranged to shut off between the canister 3 and the fuel tank 2, except for at the refueling, and to bring the fuel tank 2 to the sealed state. The blocking valve 21 is a normally closed type electromagnetic valve arranged to be closed at deenergization.

The purge port 14 is provided with a first purge control valve 23 which is disposed through the purge passage 19 to an intake system of the internal combustion engine 1, for example, a portion of an intake passage 17 on a download side of a throttle valve 18. A first purge control valve 23 is provided in the purge passage 19. The first purge control valve 23 is arranged to open and close the purge passage 19 for controlling the introduction of the purge gas into the internal combustion engine 1. The first purge control valve 23 is closed for prohibiting the introduction of the purge gas, in predetermined conditions such as non-idling state and the fuel cut state, in addition to the stop of the internal combustion engine 1. The first purge control valve 23 is a normally closed electromagnetic valve.

The drain port 15 is connected to a drain passage 25 including a tip end opened through a filter 24 to the atmosphere. A drain cut valve 26 is provided to this drain passage 25. The drain cut valve 26 is arranged to open and close the drain passage 25. This drain cut valve 26 is a normally open type electromagnetic valve arranged to be opened in the deenergized state. This drain cut valve 26 is arranged to close a system at a leakage (leak) diagnosis. Moreover, for example, when a breakthrough of the canister 3 is sensed by some means, the drain cut valve 26 is arranged to close the system. However, basically, the drain cut valve 26 is in the open state to open the drain passage 25. Moreover, a pressurizing pump 27 is provided in the drain passage 25 in parallel with the drain cut valve 26. The pressurizing pump 27 is used at the leakage diagnosis of the system. The pressurizing pump 27 and the drain cut valve 26 are integrally constituted as a leakage diagnosis module 28.

A tank open passage 31 is provided between the evaporated fuel passage 16 and the purge passage 19, specifically, between a position of the evaporated fuel passage 16 on the fuel tank 2's side of the blocking valve 21, and a position of the purge passage 19 on an upstream side (that is, the canister 3's side) of the first purge control valve 23. The tank open passage 31 connects the evaporated fuel passage 16 and the purge passage 19. A second purge control valve 32 is provided in the middle of the tank open passage 31. The second purge control valve 32 is arranged to open and close the tank open passage 31. This second purge control valve 32 is a normally closed type electromagnetic valve arranged to be closed in the deenergized state. In this case, the second purge control valve 32 has a passage area smaller than a passage area of the blocking valve 21. Specifically, as to a diameter (bore) of the port which is opened and closed by a plunger, that of the second purge control valve 32 is smaller than that of the blocking valve 21. Besides, the blocking valve 21 has a sufficiently large passage area so as not to damage (impair) the smooth refueling.

The blocking valve 21, the first purge control valve 23, the second purge control valve 32, the drain cut valve 26, and the pressurizing pump 27 are appropriately controlled by an engine controller 35 performs various controls of the internal combustion engine 1 (for example, a fuel injection amount control, an injection timing control, an ignition timing control, an opening degree control of the throttle valve 18, and so on). A reduction of the pressure within the tank before the opening of the filler cap 4 at the refueling, an adsorption processing at the refueling, the purge processing during the driving of the engine, a leakage diagnosis of portions of system, and so on are performed.

A tank pressure sensor 36 is attached to the fuel tank 2. The tank pressure sensor 36 is a pressure sensor arranged to sense the pressure in the system. An evaporation line pressure sensor 37 is attached near the purge port 14 of the canister 3. The evaporation line pressure sensor 37 is a pressure sensor arranged to sense the pressure in the system. The former tank pressure sensor 36 is arranged to sense a pressure (specifically, a pressure in the upper space of the fuel tank 2) of the region on the fuel tank 2's side in the system defined by the blocking valve 21 and the second purge control valve 32. The latter evaporation line pressure sensor 37 is arranged to sense a pressure in a region including the canister 3, in the system surrounded by the blocking valve 21, the second purge control valve 32, the drain cut valve 26, and the first purge control vale 23. Moreover, the fuel tank 2 is provided with a fuel temperature sensor 39 arranged to sense a temperature of the fuel within the fuel tank 2. An outside air temperature sensor 40 arranged to sense the outside air is provided at an appropriate position of the vehicle.

Besides, a bidirectional relief valve 38 is provided in the evaporated fuel passage 16 in parallel with the blocking valve 21. The bidirectional relief valve 38 is arranged to be mechanically opened when the pressure within the fuel tank 2 becomes extremely high, and when the pressure within the fuel tank 2 becomes extremely low.

Basically, in the thus-constructed evaporated fuel processing device, the only evaporated fuel generated at the refueling is adsorbed to the canister 3. The adsorption of the evaporated fuel by the canister 3 is not performed except for at the refueling. That is, the evaporated fuel processing device in this embodiment is preferable to a hybrid vehicle which can be traveled by an EV travelling in which the internal combustion engine 1 is stopped. In this type of vehicle, the frequency of the purge of the canister 3 is low. The adsorption of the evaporated fuel by the canister 3 is limited to the refueling.

During the refueling, in a state where the drain cut valve 26 is opened, the first purge control valve 23 and the second purge control valve 32 are closed, and the blocking valve 21 is opened. With these, the inside of the fuel tank 2 and the charge port 13 of the canister 3 are connected to each other. Accordingly, the evaporated fuel generated within the fuel tank 2 in accordance with the refueling is introduced into the canister 3, and adsorbed to the adsorption material within the canister 3.

Then, the blocking valve 21 is closed after the refueling. Accordingly, the inside of the fuel tank 2 is maintained to the sealed state to be separated from the canister 3. During the stop of the internal combustion engine 1, the adsorption amount of the canister 3 is basically not increased and decreased.

Then, when the traveling of the vehicle is restarted and the internal combustion engine 1 becomes a predetermined driving state, the first purge control valve 23 is appropriately opened in a state where the blocking valve 21 is maintained in the closed state so that the purge of the combustion components from the canister 3 is performed. That is, the atmosphere is introduced from the drain port 15 by the pressure difference with respect to the intake system of the internal combustion engine 1. The combustion components purged from the adsorption material 12 by the atmosphere is introduced through the first purge control valve 23 to the intake passage 17 of the internal combustion engine 1. Accordingly, the adsorption amount of the canister 3 is gradually decreased during the driving of the internal combustion engine 1.

After the stop of the traveling (driving) of the vehicle, the drain cut valve 26 is opened. The first purge control valve 23 and the second purge control valve 32 are closed. The blocking valve 21 is closed. These state are maintained. The fuel tank 2 is left in the sealed state. Then, when it is sensed that a predetermined time period (for example, substantially thirty minutes to fifty minutes) elapses, the leakage diagnosis is performed.

In the leakage diagnosis, basically, the inside of the system is sealed by closing the drain cut valve 26 in a state where the inside of the system is brought to the positive pressure or the negative pressure by using the positive pressure or the negative pressure existing within the fuel tank 2, or the pressurization by the pressurizing pump 27. Then, the evaporation line pressure sensor 37 or the tank pressure sensor 36 monitor the subsequent pressure variation. In a case where the pressure decrease of a predetermined level is not sensed during a predetermined time period, it is diagnosed that the leakage is not generated.

In this embodiment, a temperature difference between the fuel temperature at the start of the driving of the vehicle, and the fuel temperature after the driving, for example, at the end of the driving is determined (calculated). When this temperature difference is equal to or greater than a predetermined difference (for example, ±1 degree) regardless of the positive and negative values, it is judged that the positive pressure or the negative pressure is generated, so that a first leakage (leak) diagnosis which is not dependent on the pressurizing pump 27 is selected. When the temperature difference is smaller than the predetermined difference, the sufficient positive pressure or the sufficient negative pressure may be generated. Accordingly, a second leakage diagnosis using the pressurizing pump 27 is selected.

Accordingly, if the leakage diagnosis is performed at each stop of the driving of the vehicle, the frequency of the leakage diagnosis with the operation of the pressurizing pump 27 becomes small. Consequently, it is possible to promote the suppression of the electric power consumption.

Hereinafter, the processing of the leakage diagnosis after the stop of the vehicle is explained in detail with reference to flowcharts of FIG. 2 to FIG. 5.

Figure 2:
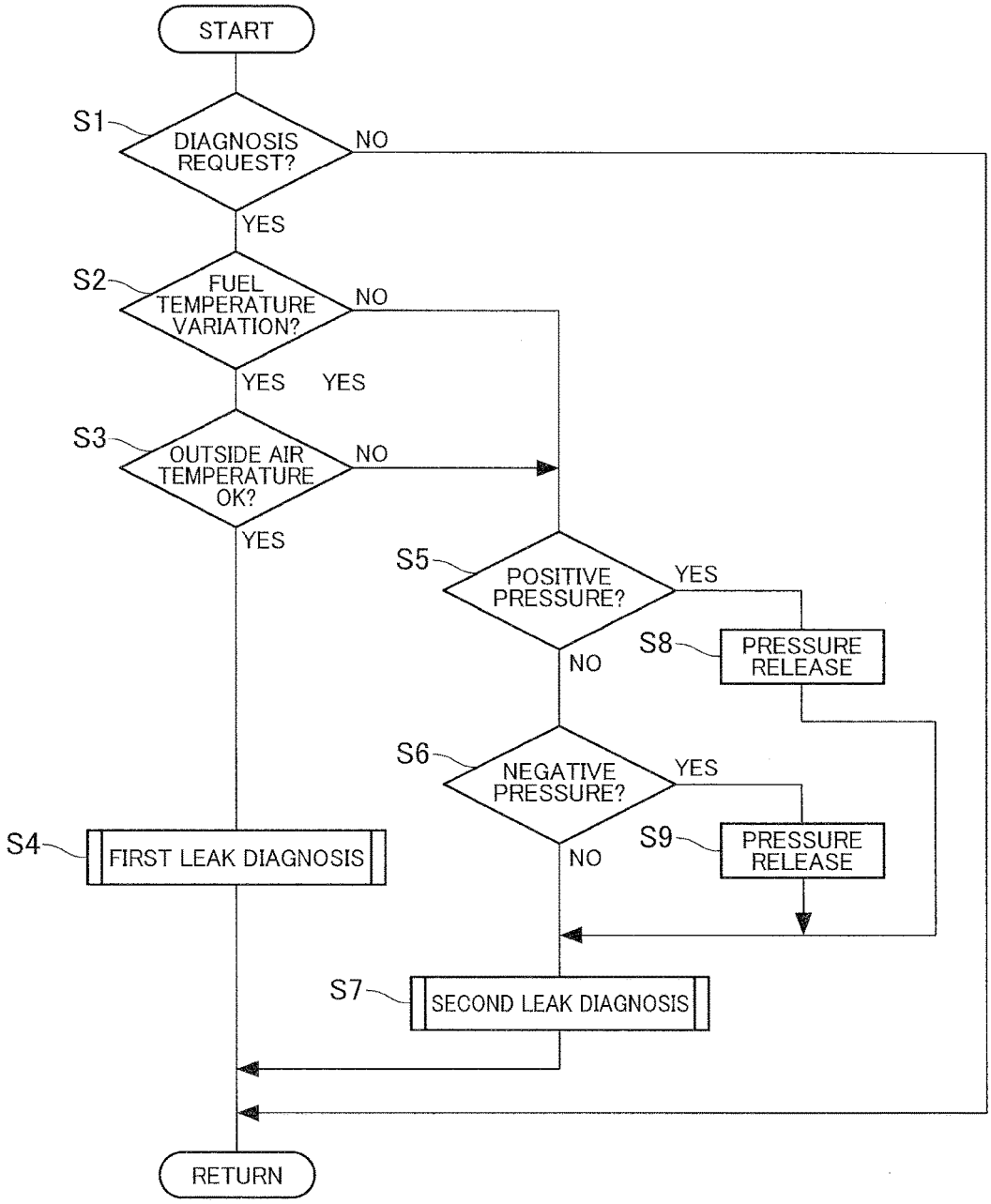
FIG. 2 is a main flowchart of a leakage diagnosis.

FIG. 2 is a main flowchart of the entire leakage diagnosis. At step 1, it is repeatedly judged whether or not there is the request of the leakage diagnosis. When the request of the leakage is generated after the predetermined time period is elapsed after the stop of the vehicle, the process proceeds to step 2. It is judged whether or not the temperature difference ΔT between the fuel temperature at the start of the driving of the vehicle, and the fuel temperature at the end of the driving is equal to or greater than a threshold value (for example, ±1 degree). When the fuel temperature is increased during the driving, the positive pressure is generated in the fuel tank 2. Conversely, when the fuel temperature is decreased, the negative pressure is generated in the fuel tank 2 (the fuel tank 2 is brought to the negative pressure state).

When the temperature difference ΔT is equal to or greater than ±1 degree, the process proceeds to step 3. It is judged whether a relative relationship between the outside air temperature and the fuel temperature is a direction to decrease or increase (promote) the temperature difference ΔT of the fuel temperature, with time. That is, in a case where the outside air temperature in the stop state of the vehicle is smaller than the fuel temperature when the fuel temperature is increased in some measure during the driving, the pressure in the system can be decreased irrespective of the leakage. Accordingly, the first leakage diagnosis is prohibited for preventing the false diagnosis. In a case where the outside air temperature during the stop of the vehicle is greater than the fuel temperature when the fuel temperature is increased during the driving, it is the direction to promote the temperature difference ΔT. The process proceeds to step 4. The first leakage diagnosis using the positive pressure existing in the fuel tank 2. Conversely, in a case where the outside air temperature in the stop state of the vehicle is higher than the fuel temperature when the fuel temperature is decreased in some measure during the driving, the pressure in the system can be increased (the negative pressure is decreased), irrespective of the leakage. Accordingly, the first leakage diagnosis is prohibited for preventing the false diagnosis. In a case where the outside air temperature during the stop of the vehicle is smaller than the fuel temperature when the fuel temperature is decreased during the driving, it is the direction to promote the temperature difference ΔT. Accordingly, the process proceeds to step 4. The first leakage diagnosis using the negative pressure existing within the fuel tank 2 is permitted.

In case of NO at step 2 or step 3, the process proceeds to step 5 and step 6. It is judged whether or not the pressure within the fuel tank 2 is the positive pressure which is equal to or greater the predetermined level, based on the detection signal of the tank pressure sensor 36. It is judged whether or not the pressure within the fuel tank 2 is the negative pressure which is equal to or greater than the predetermined level, based on the detection signal of the tank pressure sensor 36. When the pressure is not the positive pressure which is equal to or greater than the predetermined level, or the negative pressure which is equal to or greater than the predetermined level, the process proceeds to step 7. The second leakage diagnosis using the pressurizing pump 27 is performed.

At step 5 or step 6, when it is judged that the pressure within the fuel tank 2 is the positive pressure which is equal to or greater than the predetermined level, or the negative pressure which is equal to or greater than the predetermined level, the process proceeds to step 8 or step 9. The release operation of the pressure within the fuel tank 2 is performed before the second leakage diagnosis so as to exclude the influence of the positive pressure or the negative pressure within the fuel tank 2. Specifically, the second purge control valve 32 is firstly opened in a state where the drain cut valve 26 is opened. Next, the blocking valve 21 is opened to previously bring the inside of the fuel tank 2 to the substantially atmospheric pressure. Then, after the inside of the fuel tank 2 is brought to the substantially atmospheric pressure, the process proceeds to step 7. The second leakage diagnosis using the pressurizing pump 27 is performed. The second purge control valve 32 has the passage area or the diameter (bore) smaller than that of the blocking valve 21. Accordingly, by opening the second control valve 32 before the valve opening of the blocking valve 21 as described above, the initial pressure variation at the opening of the pressure becomes gentle. With this, it is possible to avoid the generation of the abnormal noise.

Figure 3:
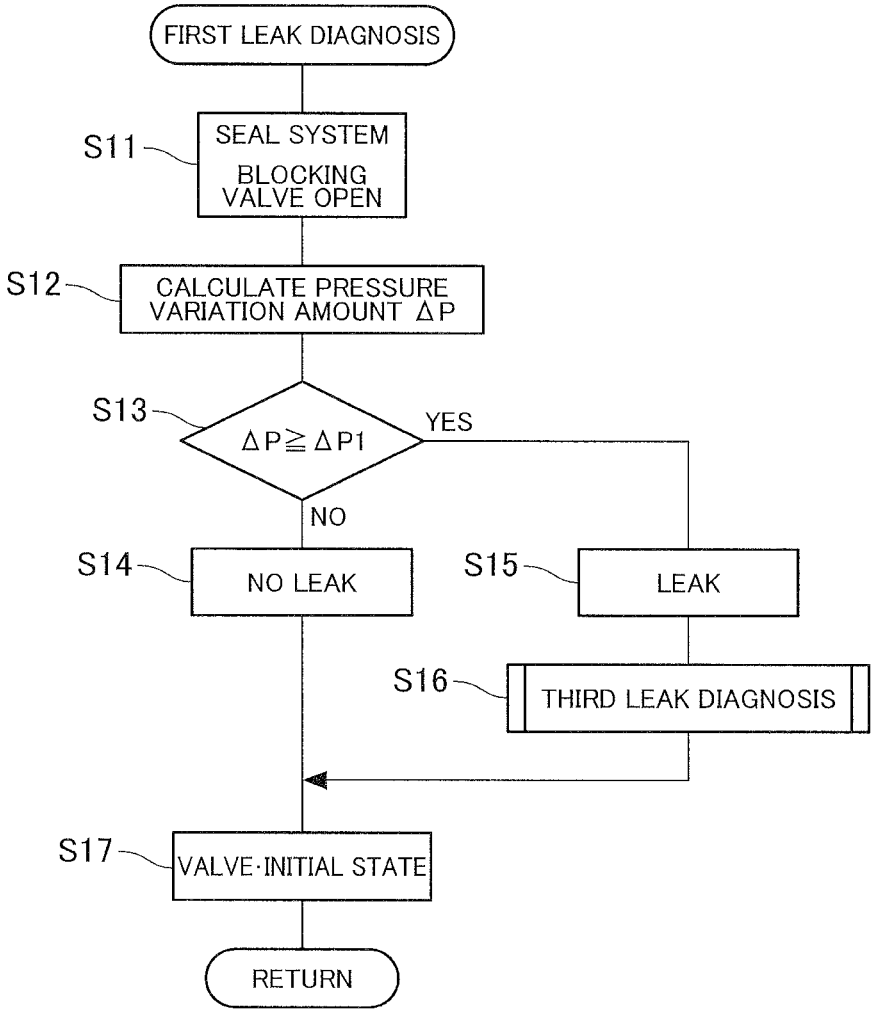
FIG. 3 is a flowchart showing a first leakage diagnosis.

FIG. 3 is a flowchart showing details of the first leakage diagnosis at step 4. At step 11, the drain cut valve 26 is closed. The blocking valve 21 is opened. The first purge control valve 23 is closed. The second purge control valve 32 is opened. That is, the entire system is brought to the sealed state as one space. By opening the blocking valve 21, the positive pressure or the negative pressure existing within the fuel tank 2 expands in the entire system.

Then, at step S12, the pressure of the system at the time at which the system is sealed is read from the detection signal of the tank pressure sensor 36 or the evaporation line pressure sensor 37. Moreover, the system pressure after the predetermined time period (for example, 40 minutes) is elapsed is read again. A difference between these system pressures, that is, a pressure variation amount ΔP during the predetermined time period is determined (calculated). At step 13, this pressure variation amount ΔP is compared with a predetermined threshold value ΔP1. When there is no pressure variation which is equal to or greater than the threshold value ΔP1 (the decrease of the positive pressure or the decrease of the negative pressure), the process proceeds to step 14. No leakage is judged. When there is the pressure variation which is equal to or greater than the threshold value ΔP1, the process proceeds to step 15. The leakage is judged. Moreover, the process proceeds to step 16 for specifying whether a portion of the leakage is on the fuel tank 2 side or the canister 3 side. At step 16, a leakage diagnosis (third leakage diagnosis) of the region on the fuel tank 2 side is performed. After the judgment of the existence of the leakage, at step 17, the valves such as the blocking valve 21 are finally returned to the initial states.

Figure 4:
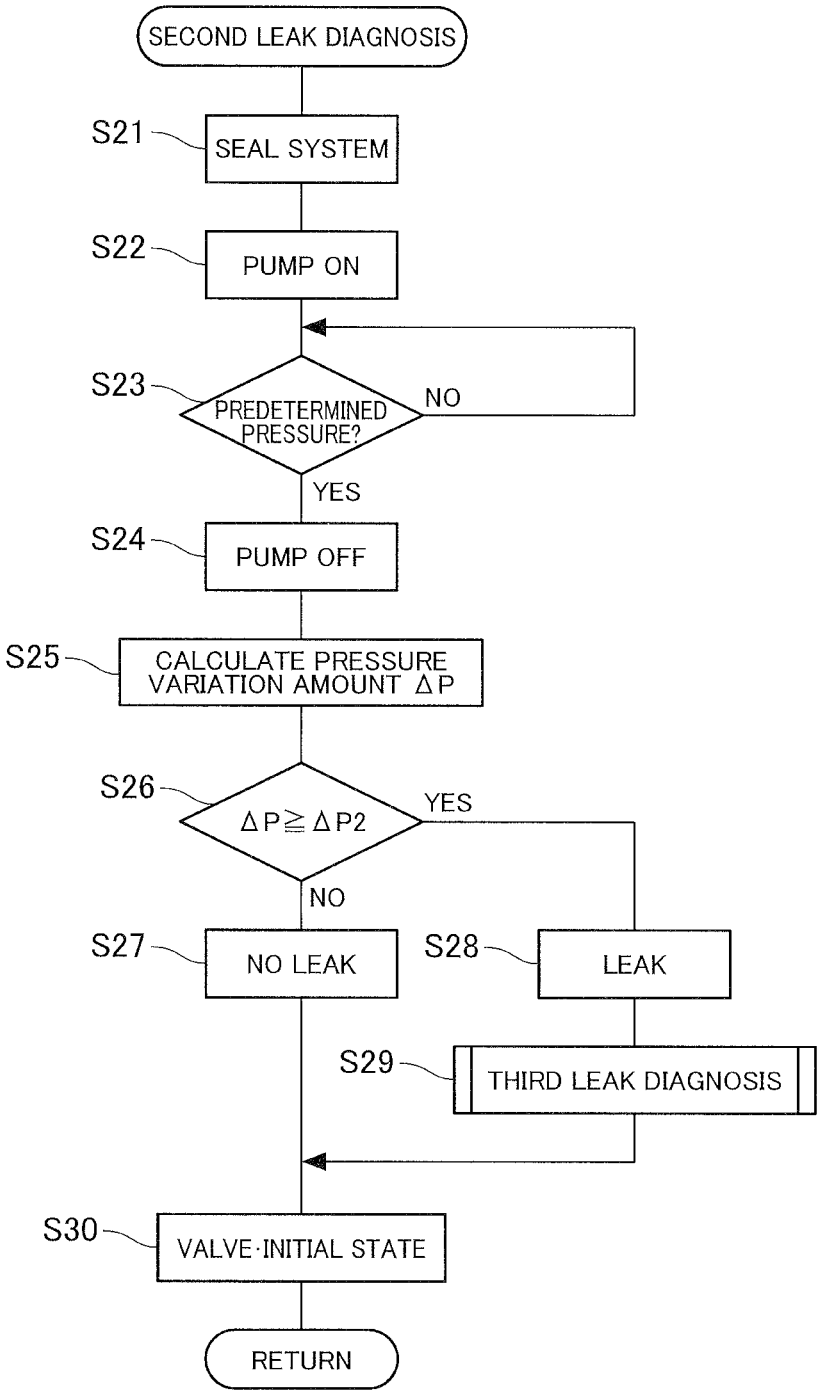
FIG. 4 is a flowchart showing a second leakage diagnosis.

FIG. 4 is a flowchart showing details of the second leakage diagnosis at step 7. At step 21, the drain cut valve 26 is closed. The blocking valve 21 is opened. The first purge control valve 23 is closed. The second purge control valve 32 is opened. That is, the entire system is brought to the sealed state as one space. Next, at step 22, the pressurizing pump 27 is switched to the ON state to pressurize the inside of the system. At step 23, it is judged whether or not the inside of the system reaches the pressure necessary for the diagnosis. When the inside of the system reaches the predetermined pressure, the process proceeds to step 24. The pressurizing pump 27 is switched to the OFF state. With this, the entire system becomes the pressurized state.

Subsequent operations are basically identical to those of the first leakage diagnosis. At step 25, the system pressure after the predetermined time period (for example, four minutes) is elapsed is read again. A difference between the system pressure after the predetermined time period, and the predetermined pressure at the stop of the pressurizing pump 27, that is, the pressure variation amount ΔP during the predetermined time period is determined (calculated). At step 26, this pressure variation amount ΔP is compared with the predetermined threshold value ΔP2. When there is no pressure decrease which is equal to or greater than the threshold value ΔP2, the process proceeds to step 27. No leakage is judged. When there is the pressure decrease which is equal to or greater than the threshold value ΔP2, the process proceeds to step 28. The leakage is judged. Moreover, the process proceeds to step 29 so as to specify whether the portion of the leakage is on the fuel tank 2 side or the canister 3 side. The leakage diagnosis (the third leakage diagnosis) of the fuel tank 2 side is performed. After the judgment of the existence of the leakage, at step 30, the valves such as the blocking valve 21 are finally returned to the initial states.

At the first leakage diagnosis shown in FIG. 3 or the second leakage diagnosis shown in FIG. 4, the sensed pressure of the tank pressure sensor 36 and the sensed pressure of the evaporation line pressure sensor 37 are compared with each other. With this, it is possible to perform the diagnosis of a closing fixation (including an abnormality in which the opening degree is small) of the blocking valve 21. That is, in a state where the blocking valve 21 is opened, the both sensed pressures are substantially identical to each other. Accordingly, when the both sensed pressures are deviated from each other by the allowable range or more, it is possible to be judged that the blocking valve 21 is in the closing fixation state.

Figure 5:
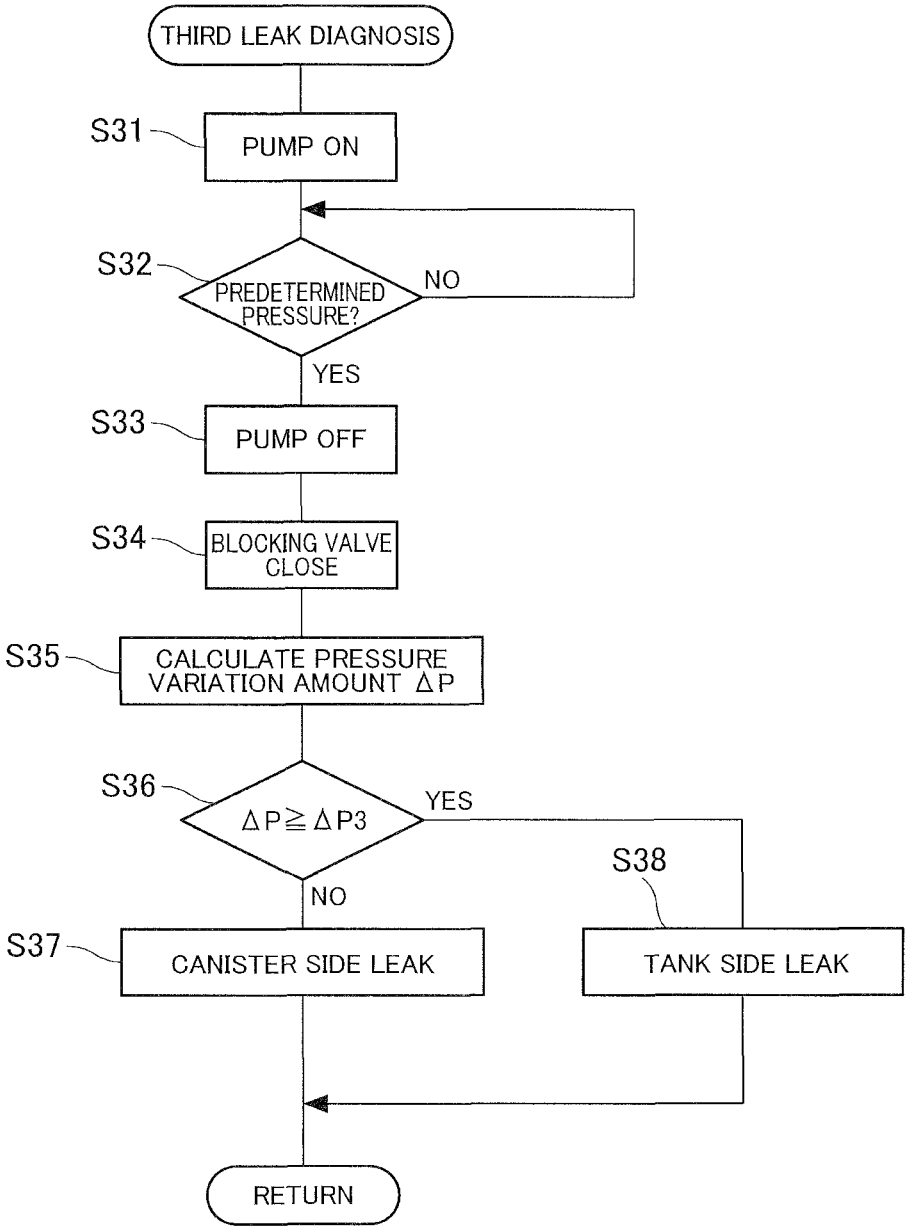
FIG. 5 is a flowchart showing a leakage diagnosis of a region on a fuel tank side.

FIG. 5 is a flowchart of the third leakage diagnosis of step 16 and step 29, that is, the leakage diagnosis for the region on the fuel tank 2 side with respect to the blocking valve 21. At step 31, the pressurizing pump 27 is switched to the ON state to pressurize the entire system. At step 32, it is judged whether or not the sensed pressure of the tank pressure sensor 36 reaches the predetermined pressure necessary for the diagnosis. When the sensed pressure reaches the predetermined pressure, the process proceeds step 33 and 34. The pressurizing pump 27 is switched to the OFF state. The blocking valve 21 is closed. The second purge control valve 32 is closed. With this, the region which is on the fuel tank 2 side, and which is defined by the blocking valve 21 is pressurized to be in the sealed state. At step 35, the system pressure after the predetermined time period (for example, 40 minutes) is elapsed is read again. A difference between this system pressure after the predetermined time period, and the predetermined pressure at the stop of the pressurizing pump 27, that is, the pressure variation amount ΔP during the predetermined time period is determined (calculated). At step 36, this pressure variation amount ΔP is compared with the predetermined threshold value ΔP3. When there is no pressure decrease which is equal to or greater than the threshold value ΔP3, the process proceed to step 37. It is judged that the portion of the leakage is the region on the canister 3 side. When there is the pressure decrease which is equal to or greater than the threshold value ΔP3, the process proceeds to step 38. It is judged that the portion of the leakage is the region on the fuel tank 2 side.

Hereinabove, one embodiment according to the present invention is explained. However, the present invention is not limited to the above-described embodiment. Various variations are applicable. For example, in the above-described embodiment, the system is pressurized by the pressurizing pump 27. However, the leakage diagnosis may be performed by decreasing the pressure by the pressure decreasing pump.

The invention claimed is:

1. A diagnosis device for an evaporated fuel processing device arranged to adsorb an evaporated fuel generated in a fuel tank at a refueling by a canister, and to process by introducing the evaporated fuel to an intake system of an internal combustion engine during a driving operation of the internal combustion engine, the diagnosis device comprising:

a pump arranged to pressurize or depressurize a system including the fuel tank and the canister;

at least one pressure sensor arranged to sense a pressure within the system;

a fuel temperature sensor arranged to sense a temperature of a fuel within the fuel tank; and a controller configured to select a first leakage diagnosis using a positive pressure or a negative pressure existing within the fuel tank, or a second leakage diagnosis using a forcible pressurization or a forcible depressurization by the pump, based on a temperature difference between a fuel temperature at a start of the driving operation, and a fuel temperature after an end of the driving operation, with respect to a request of a leakage diagnosis.

2. The diagnosis device for the evaporated fuel processing device as claimed in claim 1, wherein the first leakage diagnosis is prohibited when a relative relationship between an outside air temperature and a fuel temperature at the request of the leakage diagnosis is in a direction in which the temperature difference of the fuel temperature is decreased with time.

3. The diagnosis device for the evaporated fuel processing device as claimed in claim 1, wherein a pressure release operation is performed before the operation of the pump when the system is in the positive pressure or the negative pressure which is equal to or greater than a predetermined level when the second leakage diagnosis is selected based on the temperature difference.

4. The diagnosis device for the evaporated fuel processing device as claimed in claim 1, wherein the controller further comprises a blocking valve provided in an evaporated fuel passage from the fuel tank to the canister; and the leakage diagnosis in a region which is separated by the blocking valve, and which is on the fuel tank side, or a leakage diagnosis in a region which is separated by the blocking valve, and which is on the canister side is performed by using the pump when the leakage is sensed by the first leakage diagnosis or the second leakage diagnosis.

5. The diagnosis device for the evaporated fuel processing device as claimed in claim 3, wherein the evaporated fuel processing device further comprises a blocking valve provided in an evaporated fuel passage from the fuel tank to the canister; and in the pressure release operation, the fuel tank becomes closer to the atmospheric pressure by opening an electromagnetic valve having a passage area smaller than a passage area of the blocking valve, and then the blocking valve is opened.

* * * * *